US005445529A

United States Patent [19]

Yamamoto

[11] Patent Number: 5,445,529

[45] Date of Patent: Aug. 29, 1995

[54] CONNECTOR APPARATUS

[75] Inventor: Nobumasa Yamamoto, Yokohama, Japan

[73] Assignee: Berg Technology, Inc., Reno, Nev.

[21] Appl. No.: 149,308

[22] Filed: Nov. 9, 1993

[30] Foreign Application Priority Data

Nov. 9, 1992 [JP] Japan ..... 4-077087

[51] Int. Cl.[6] ..... H01R 9/09; H01R 4/48

[52] U.S. Cl. ..... 439/81; 439/83; 439/74

[58] Field of Search ..... 439/74, 83, 295; 431/81

[56] References Cited

U.S. PATENT DOCUMENTS 4,917,614 4/1990 Kikuchi et al. ..... 439/83
5,199,884 4/1993 Kaufman et al. ..... 439/74
5,306,163 4/1994 Asakawa ..... 439/74

*Primary Examiner*—Kenneth J. Ramsey
*Attorney, Agent, or Firm*—Woodcock, Washburn, Kurtz, MacKiewicz & Norris

[57] ABSTRACT

A board-to-board interconnect connector apparatus is provided which substantially improves electrical connection even when some positional displacement occurs between a receptacle housing and a header housing. The connector apparatus includes the receptacle housing mountable on a mother board and the header housing mountable on a daughter board. Receptacle contact terminals are arranged in a parallel array in the receptacle housing, and header contacts terminals are arranged in another parallel array in the header housing. The surface of the contact terminal is angled relative to the direction of a pitch of the contact terminals. Thus, when some positional displacement of the receptacle housings occurs in the pitch array direction of the contact terminals, the receptacle contact terminals are kept in contact with the header contact terminals.

11 Claims, 5 Drawing Sheets

CONNECTOR APPARATUS

BACKGROUND OF THE INVENTION

Field of the Invention

The present invention relates to a connector apparatus and, in particular, to a board-to-board interconnector.

Description of the Related Art

In a board-to-board interconnector system, a daughter-board-mountable header housing is fitted into a mother-board-mountable receptacle housing. In the header housing and receptacle housing, a plurality of contact terminals are arranged in a parallel array. When the header housing is fitted in the receptacle housing, contact terminals in the header housing are set in contact with a corresponding contact terminal in the receptacle housing whereby the daughter board is connected to the mother board. The area of contact between the contact terminals is made by the face of a conductive sheet. The contact terminals are designed to accommodate overall dimensional limits of the connector housing. In general, a contact area or face is situated parallel to the direction of a pitch of the contact terminals.

The header and receptacle housings are molded by an ordinary molding method. It is difficult to exactly determine their finished dimensions for the mold from design values for desirable fitting of the housings. Thus, when both the housings are fitted together, these housings may undesirably be displaced in the direction of a pitch of the contact terminals or in the direction of the array of the contact terminals. Since the contact face is displaced relative to that of the corresponding contact terminal, an improper electrical connection may result.

If these contact terminals are contacted with each other on their surfaces where the conductive sheet is curved or arched, a broader contact area is secured for a stable contact. If, however, the contact terminals are arranged at a narrow pitch of, for example, 0.8 mm to 0.5 mm, their dimensional limitations prevent a proper and steady contact on their curved surfaces.

Summary of the Invention

Accordingly, the object of the present invention is to provide a connector apparatus which allows a larger dimensional range of molded component parts and secures a broader contact surface between associated contact terminals.

According to the present invention, there is provided a connector apparatus for connecting together first and second boards, comprising:

- a first housing mountable on the first board and made of an insulating material;
- a plurality of first contact terminals arranged at a first predetermined pitch in a first parallel array in the first housing, each of the first contact terminal including a contact portion for establishing an electrical connection with the first board, each contact portion being angled with respect to a direction of the first pitch;
- a second housing mountable on the second board and made of an insulating material, the second housing being fitted into the first housing; and
- a plurality of second contact terminals arranged at a second predetermined pitch in a second parallel array in the second housing, and each of the second contact terminal including a contact portion for establishing an electrical connection to the second board, each contact portion being angled with respect to a direction of the second pitch, wherein
- the first and second housings having a predetermined range of transverse movement with respect to each other while maintaining the first and second contact terminals substantially in contact.

According to one aspect of the connector apparatus, since the contact surface between the first and second contact terminals is angled relative to the direction of the pitch of the contact terminals, the first and second housings are maintained for an electrically stable connection even though the two housings are displaced in the pitch direction.

Further, since the contact surface above is situated in the longitudinal direction as viewed in the cross-section of the contact portion of the contact terminal, a wider contact surface can be secured and, even if the first and second housings are displaced in a direction in which the contact terminals are arranged, a stable contact state can be secured between the first and second contact terminals.

Detailed Description of the Preferred Embodiments

An embodiment of the present invention will be explained below with reference to the accompanying drawings.

Figure 1:
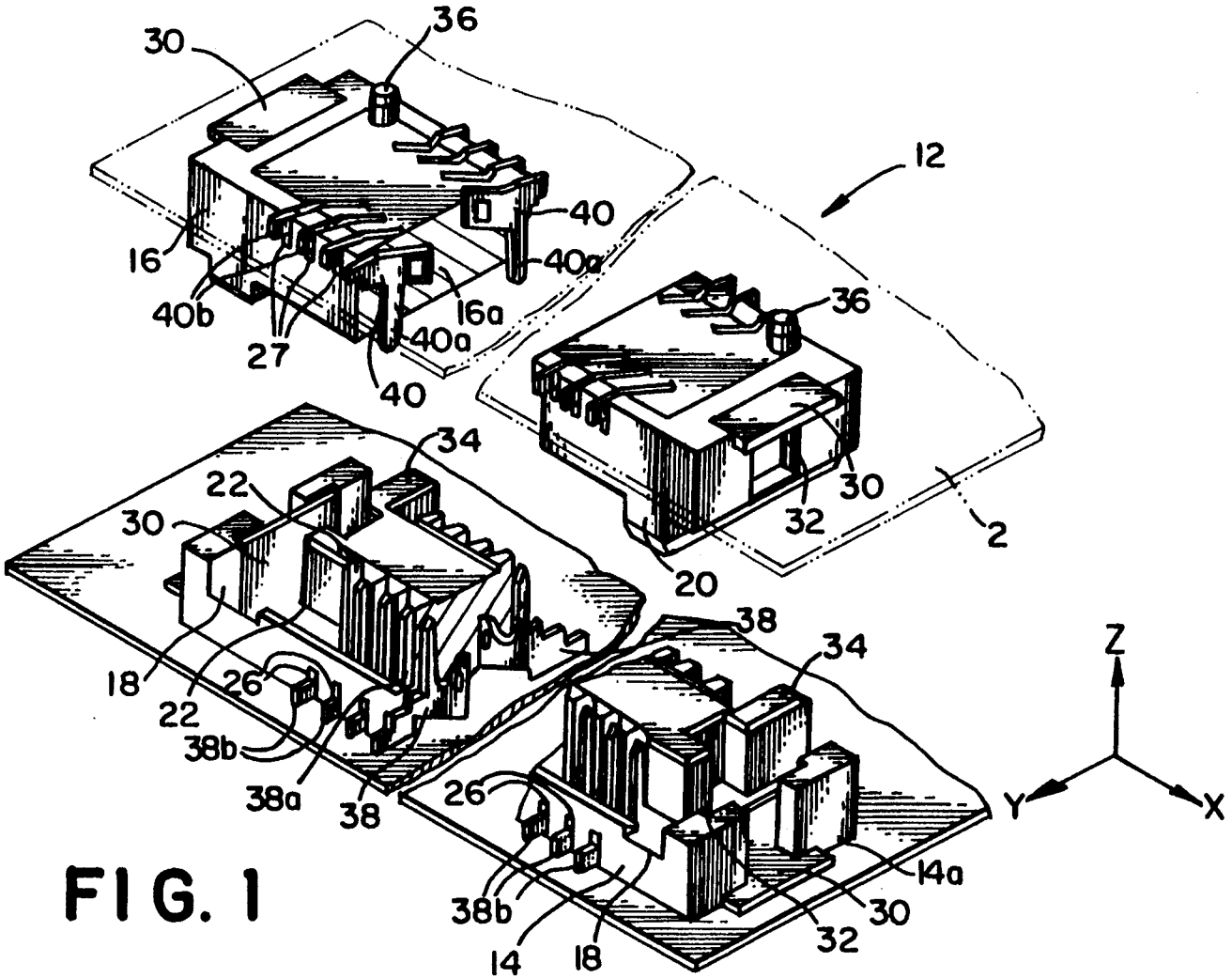
FIG. 1 is a perspective view showing a connector apparatus according to an embodiment of the present invention.

Referring to FIG. 1, a board-to-board interconnector apparatus 12 of the present invention includes a receptacle housing 14 mountable on a mother board 1 and a header housing 16 mountable on a daughter board 2. Edges of the daughter board 2 are indicated by a phantom line so as to show more structures of the header housing 16. These housings 14 and 16 are connectable in a mutual fitting relation. A conventional system can be adopted. However, according to a preferred embodiment, engaging projections 20 are provided at each end portion of the housing 16 for engaging recesses 18 in the corresponding portion of the housing 14. In each of FIGS. 1–9, the direction of length, width and height for the housings 14 and 16 are respectively indicated by X, Y, and Z. Further, the lower surfaces 14*a* and 16*a* of the housings 14 and 16 face the boards 1 and 2, respectively.

Still referring to FIG. 1, a plurality of recesses 24 is provided in a parallel pattern which extends from an upper surface to lower surface of the housing 14. A plurality of recesses 24 is provided in a parallel pattern which extends from an upper surface to a lower surface of the housing 16. In the vicinity of the lower side surfaces of the housings 14 and 16, a row of slits 26 and is provided in the X direction. The respective slits 26 and 27 are respectively continuous with the recesses 22 and 24.

A pair of mount pegs 30 is preferably provided at each end of the respective housing so as to mount the housing on the corresponding board. The mount peg 30 is substantially L-shape in a cross section and fitted in a corresponding recess 32 of the housings 14 and 16.

It is preferable that the configuration of the housings 14 and 16 be made nonsymmetrical along the x axis so as to make their polarities distinct. A preferred embodiment is shown in FIG. 1 with a pair of polarity projections 34 at each side portion of the upper surface of the housings 14 along with a pair of orientation posts 36 on the upper surface of the housing 16. Contact terminals 38 and 40 are placed from the lower surface sides of the housings 14 and 16 into the corresponding recesses 22 and 24 of the housings 14 and 16. The contact terminals 38, 40 have a pitch direction in the X direction. The pitch is, for example, 0.8 mm. for one preferred embodiment according to the current invention.

The contact terminals 38 and 40 are formed by punching or bending a gold-plated conductive sheet. The conductive sheet material includes a phosphor bronze sheet.

Figure 2:
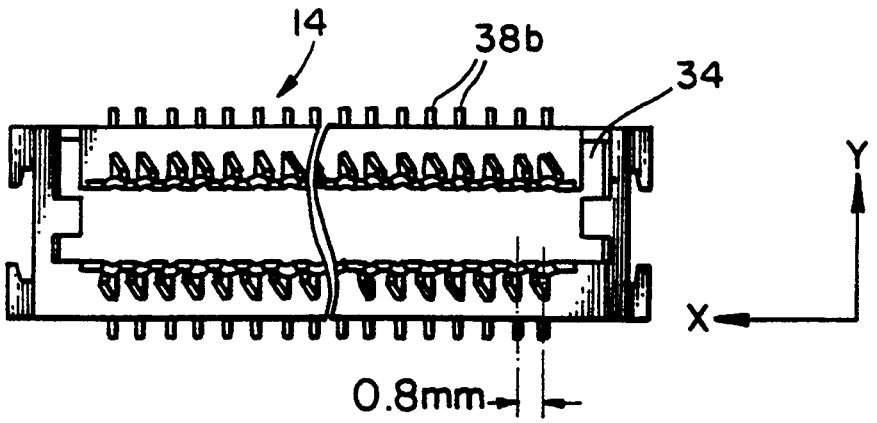
FIG. 2 is a top view showing a receptacle housing in FIG. 1.
Figure 3:
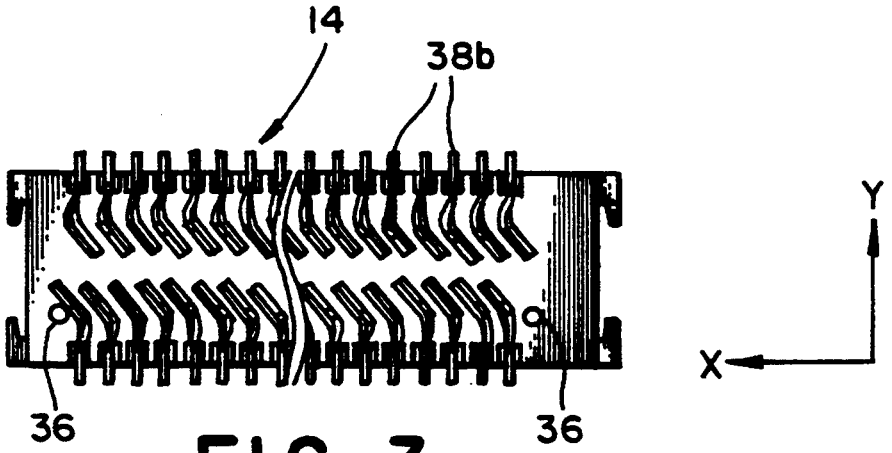
FIG. 3 is a bottom view of the receptacle as shown in FIG. 2.
Figure 4:
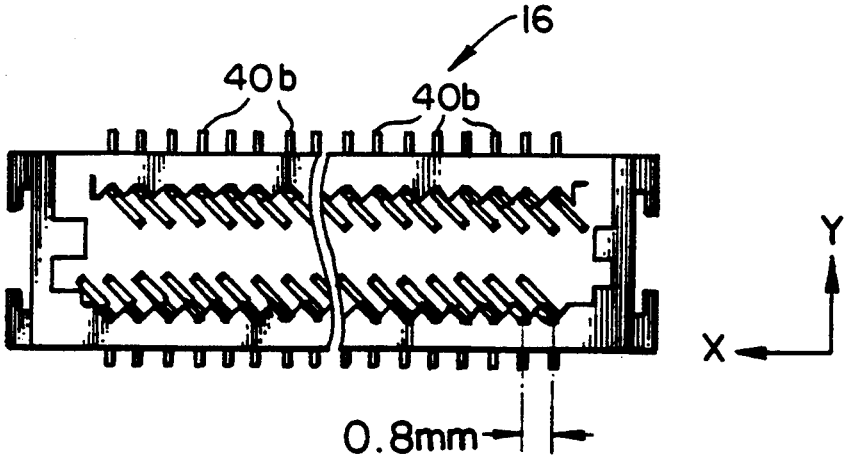
FIG. 4 is a top view showing a header housing as shown in FIG. 1.
Figure 5:
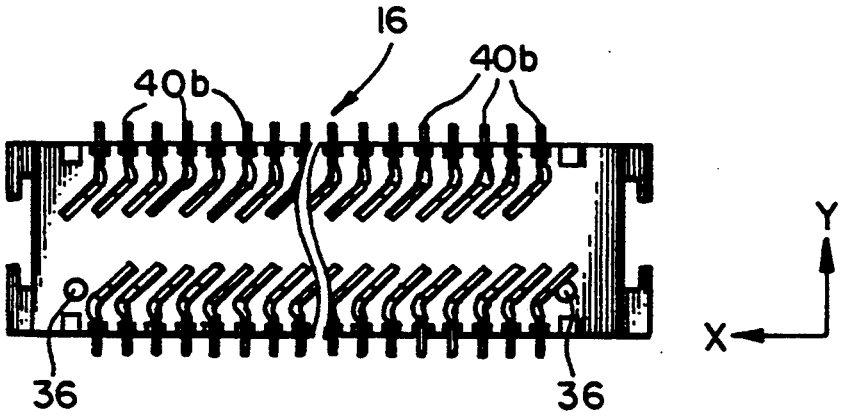
FIG. 5 is a bottom view of the header housing as shown in FIG. 4.

FIGS. 2 and 3 respectively show the receptacle housing 14 in a top and bottom view. FIGS. 4 and 5 respectively show the header housing 16 in a top and bottom view.

Figure 6:
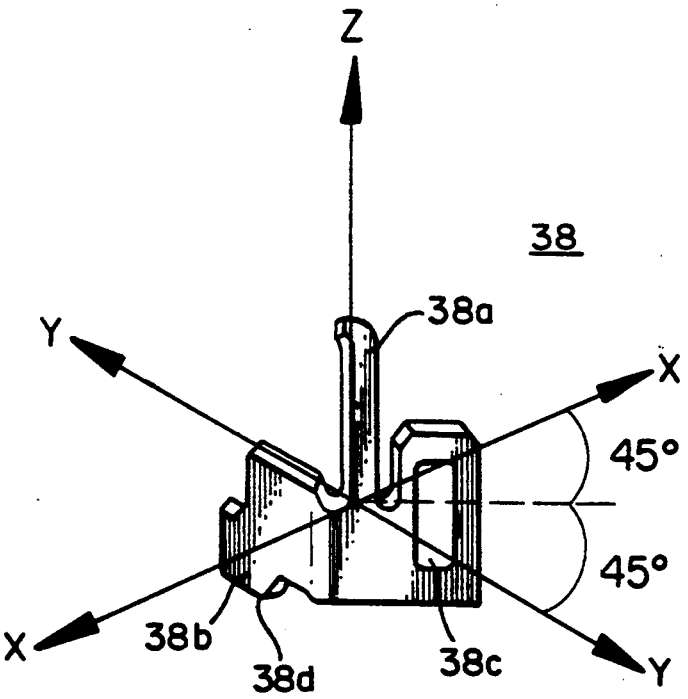
FIG. 6 is a perspective view showing a receptacle contact terminal.

As shown in FIG. 6, the receptacle-side contact terminal 38 includes a contact portion 38*a* extending in the z direction, a solder tail 38*b* and a pressure contact portion 38*c* between the contact portion 38*a* and the solder tail 38*b* in the z direction. The contact portion 38*a* is substantially rectangular. 38*d* is an intermediate section between the solder tail 38*b* and the contact portion 38*a*. A cross section of the rectangular area corresponds to the end face and rolled surface of the phosphor bronze sheet.

When the contact terminal 38 in the receptacle housing 14 is viewed on an X-Y plane, the solder tail 38*b* extends along the Y direction and is partially protected by the corresponding slit 26 in the receptacle housing 14. In a preferred embodiment, the contact portions 38*a* and pressure contact portion 38*c* are angled 45° with respect to the X-Y plane.

Figure 7:
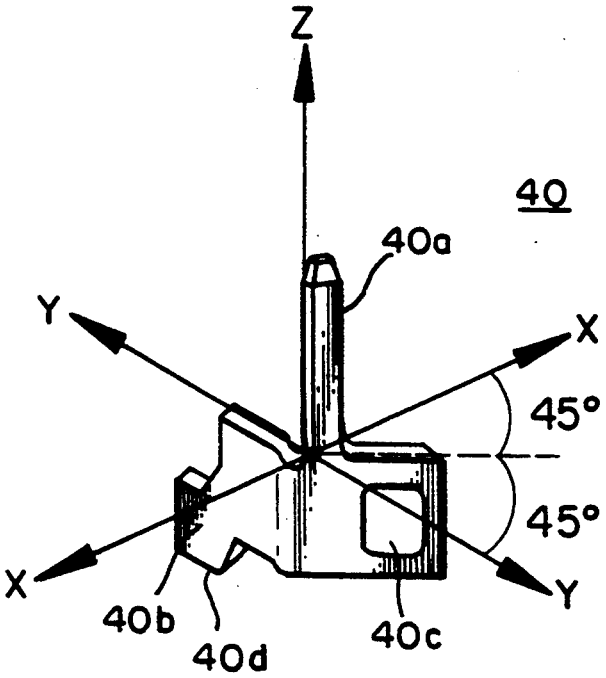
FIG. 7 is a perspective view showing a header contact terminal.

As shown in FIG. 7, the header-side contact terminal 40 includes a contact portion 40*a* extending in the Z direction, a solder tail 40*b* and a pressure contact portion 40*c* between the contact portion 40*a* and the solder tail 40*b*. The contact portion 40*a* has a longitudinal area. The contact portion 40*a* and pressure contact portion 40*c* are angled 45° with respect to the X-Y plane. The longitudinal area of the contact portion 40*a* corresponds to a arched or curved surface. The solder tail 40*b* of the contact terminal 40 extends in the Y direction such that it is partially protected by the slit 28 in the header housing 16. An intermediate area 40*d* is located between the solder tail 40*b* and the pressure contact portion 40*c*. The connectors 38, 40 are respectively positioned and held in place in housings 14, 16 by the pressure contact portion 38*c* and 40*c*.

Figure 8:
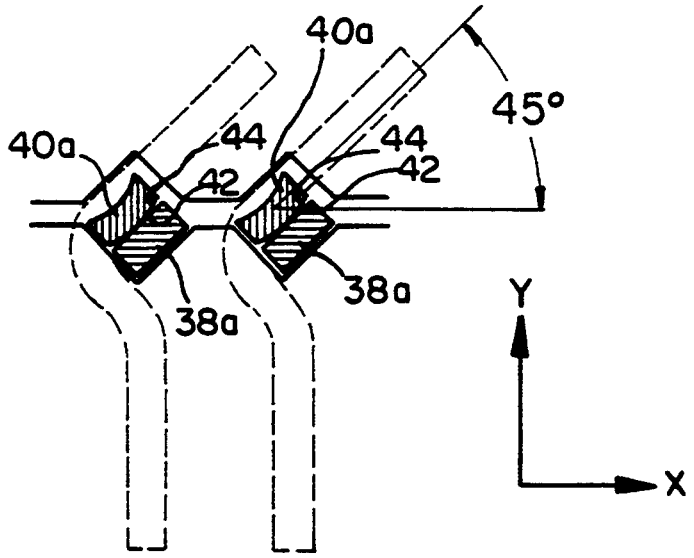
FIG. 8 is a cross-sectional view showing a contacting state between the receptacle contact terminal and the header contact terminal.

When the receptacle housing 14 is fitted into the header housing 16, as shown in a cross section of FIG. 8, the contact portion 38*a* of the receptacle-side contact terminal 38 is brought into contact with the contact portion 40*a* of the header-side contact terminal 40 along the Z direction. Since contact surfaces 42 and 44 are angled on the X-Y plane, the contact portions 38*a* and 40*a* of the contact terminals 38 and 40 are kept in contact with each other even if some positional displacement exists between the housings 14 and 16 in the X or Y direction. Further, the curved contact surface 44 also help secure a contact for some displacement of the contact terminals.

Assume that the contact surfaces 42 and 44 are parallel with each other in the X direction. The positional displacement between the housings 14 and 16 directly becomes a positional displacement between the contact surfaces 42 and 44. According to the present invention, however, the contact surfaces 42 and 44 are angled relative to the X direction so as to substantially eliminate the effect of the positional displacement of the housings 14 and 16 on the contact surfaces 42 and 44. If the positional displacement between the housings 14 and 16 in the X direction is given by 1 with respect to the contact surfaces 42 and 44 in the X direction which are angled at 45°, the positional displacement between the contact surfaces 42 and 44 is represented by:

$$\cos 45° \approx 0.7$$

That is, the positional displacement between the housings 14 and 16 can be suppressed or reduced to 0.7 times the positional displacement.

Figure 9:
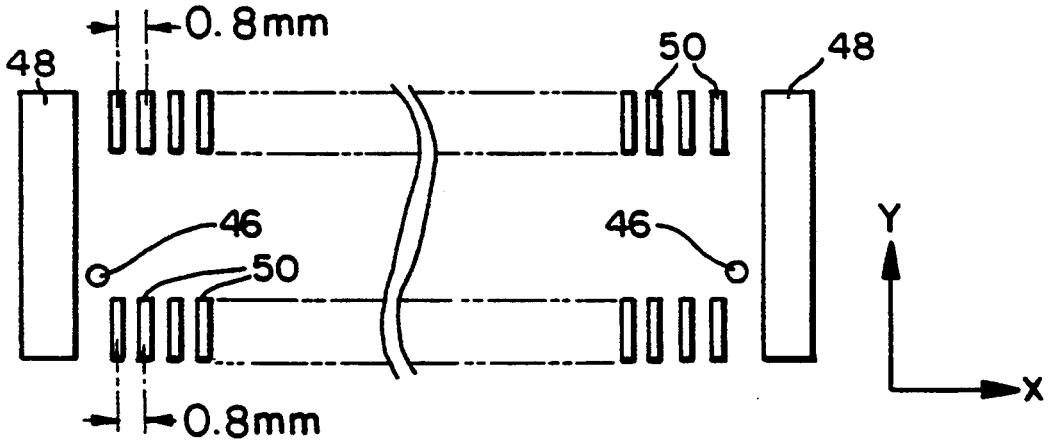
FIG. 9 is a top view showing a layout on the surface of a mother board.

FIG. 9 shows a surface layout of the mother board 1 on which the receptacle housing 14 is mounted. A pair of orientation posts 36 is inserted into a corresponding pair of mounting holes 46. The lower surfaces of the mount pegs 30 are soldered to the corresponding solder pads 48. Lower surfaces of the intermediate area 38*d* of the solder tails 38*b* of the contact terminals 38 are soldered to those corresponding solder pads 50.

Although not shown, the daughter board 2 has a similar layout to one shown in FIG. 9. The header housing 16 is mounted on the daughter board 2 by inserting the orientation posts 36 into associated mount holes and soldering the contact terminal 40 at the lower surface 40*d* of its solder tail and the lower surface of the mount peg 30.

When the housings 14 and 16 are respectively mounted on the mother board 1 and daughter board 2, the boards 1 and 2 are electrically connected together through the contact terminals 38 and 40.

According to the connector apparatus of the present invention, as already set out above, a broader contact surface area is secured between the first and second contact terminals, and the contact surface area is angled to the pitch direction of the contact terminals. Thus, even if some mating positional displacement exists between the first and second housing, the electrical contact between the contact terminal is substantially maintained.

What is claimed is:

1. A connector apparatus for connecting together first and second boards, comprising:

a first housing mountable on the first board and made of an insulating material;

a plurality of first contact terminals arranged at a first predetermined pitch in a first parallel array in the first housing, each of the first contact terminal including a single surface defining a first contact portion for establishing an electrical connection with the first board, the first contact portion being angled with respect to a direction of the first pitch;

a second housing mountable on the second board and made of an insulating material, the second housing being fitted into the first housing; and a plurality of second contact terminals arranged at a second predetermined pitch in a second parallel array in the second housing, each of the second contact terminals including a single surface defining a second contact portion for establishing an electrical connection to the defining second board, the second contact portion being angled with respect to a direction of the second pitch, wherein the first and second housings having a predetermined range of transverse movement with respect to each other while maintaining the first and second contact terminals substantially in contact.

2. The connector apparatus according to claim 1 wherein a surface of the first contact portion of the first contact terminal is curved.

3. The connector apparatus according to claim 1 wherein a surface of the second contact portion of the second contact terminal is curved.

4. The inter-board connector apparatus according to claim 1 wherein said longitudinal axis of the first connector housing is parallel to that of the second connector housing when the first connector housing engages the second connector housing.

5. The inter-board connector apparatus according to claim 4 wherein said first contact surface is angled at 45 degrees with respect to a longitudinal axis of the first connector housing on a plane parallel to the first board.

6. The inter-board connector apparatus according to claim 5 wherein said second contact surface is angled at 45 degrees with respect to a longitudinal axis of the second connector housing on a plane parallel to the second board.

7. The inter-board connector apparatus according to claim 1 wherein said first contact terminal further comprises a solder tail portion contiguously located on one side of said first contact surface for soldering and a pressure contact portion contiguously located on the other side of said second contact surface for anchoring said first contact terminal to said first connector housing.

8. The inter-board connector apparatus according to claim 1 wherein said second contact terminal further comprises a solder tail portion contiguously located on one side of said second contact surface for soldering and a pressure contact portion contiguously located on the other side of said second contact surface for anchoring said second contact terminal to said second connector housing.

9. The inter-board connector apparatus according to claim 1 wherein a plurality of said first contact terminals is placed along a longitudinal axis of the first connector housing.

10. The inter-board connector apparatus according to claim 1 wherein a plurality of said second contact terminals is placed along a longitudinal axis of the second connector housing.

11. An inter-board connector apparatus for electrically connecting a first board to a second board, a first connector housing being mounted on the first board, a second connector housing being mounted on the second board, comprising:

a first contact terminal located in the first connector housing, said first connector housing having a first longitudinal axis, a portion of said first contact terminal having a single surface defining a first contact surface, said first contact surface being oriented at an acute angle with respect to said first longitudinal axis; and a second contact terminal located in the second connector housing, said second connector housing having a second longitudinal axis, a portion of said second contact terminal having a single surface defining a second contact surface, said second contact surface being oriented at an acute angle with respect to said second longitudinal axis, said first contact surface and said second contact surface making contact when the first connector housing engages the second connector housing.

* * * * *

UNITED STATES PATENT AND TRADEMARK OFFICE

CERTIFICATE OF CORRECTION

PATENT NO. : 5,445,529

DATED : August 29, 1995

INVENTOR(S) : Nobumasa Yamamoto

It is certified that error appears in the above-indentified patent and that said Letters Patent is hereby corrected as shown below:

Column 5, Line 3 - "terminal" should be typed as "terminals".

Signed and Sealed this

Twenty-sixth Day of December, 1995

*Attest:*

Bruce Lehman

BRUCE LEHMAN

*Attesting Officer*

*Commissioner of Patents and Trademarks*